US008132453B2

(12) United States Patent
Thambynayagam et al.

(10) Patent No.: US 8,132,453 B2
(45) Date of Patent: Mar. 13, 2012

(54) METHOD FOR ANALYSIS OF PRESSURE RESPONSE IN UNDERGROUND FORMATIONS

(75) Inventors: Raj Kumar Michael Thambynayagam, Sugar Land, TX (US); Jeffrey Spath, Missouri City, TX (US); Raj Banerjee, Abingdon (GB); David Brian White, Fen Ditton (GB); Peter Allan Goode, Lavender Bay (AU)

(73) Assignee: Schlumberger Technology Corporation, Sugar Land, TX (US)

( * ) Notice: Subject to any disclaimer, the term of this patent is extended or adjusted under 35 U.S.C. 154(b) by 655 days.

(21) Appl. No.: 11/914,219

(22) PCT Filed: May 10, 2005

(86) PCT No.: PCT/GB2005/001820

§ 371 (c)(1),
(2), (4) Date: Oct. 30, 2008

(87) PCT Pub. No.: WO2006/120366

PCT Pub. Date: Nov. 16, 2006

(65) Prior Publication Data

US 2009/0114009 A1 May 7, 2009

(51) Int. Cl.
*E21B 49/08* (2006.01)
*E21B 47/06* (2006.01)

(52) U.S. Cl. ..... 73/152.27; 73/152.51

(58) Field of Classification Search ..... 73/152.24, 73/152.27, 152.51; 702/6, 11
See application file for complete search history.

(56) References Cited

U.S. PATENT DOCUMENTS

| | | | | |
|---|---|---|---|---|
| 5,184,508 | A * | 2/1993 | Desbrandes | 73/152.05 |
| 5,233,866 | A | 8/1993 | Desbrandes | |
| 5,379,216 | A * | 1/1995 | Head | 702/12 |
| 5,602,334 | A * | 2/1997 | Proett et al. | 73/152.05 |
| 5,644,076 | A * | 7/1997 | Proett et al. | 73/152.41 |
| 5,789,669 | A | 8/1998 | Flaum | |
| 7,031,841 | B2 * | 4/2006 | Zazovsky | 702/12 |
| 7,243,537 | B2 * | 7/2007 | Proett et al. | 73/152.51 |
| 7,331,223 | B2 * | 2/2008 | Zazovsky | 73/152.51 |
| 7,558,716 | B2 | 7/2009 | Hammond | |
| 7,647,824 | B2 * | 1/2010 | Wu et al. | 73/152.02 |

(Continued)

FOREIGN PATENT DOCUMENTS

EP 0698722 A2 2/1996

(Continued)

OTHER PUBLICATIONS

Carlslaw et al, "The use of Green's Functions in the solution of the equation of conduction", Conduction of Heat in Solids, Second Edition, Clarendon Press, 1959, Oxford, p. 378 (equations 7, 8 and 9).

(Continued)

*Primary Examiner* — John Fitzgerald

(57) ABSTRACT

A reservoir pressure in an underground formation surrounding a well is analyzed based on a direct measurement of the pressure at the wall of the well using the permeability of mud cake on the wall of the well in the region in which the pressure measurement is made; determining the thickness of mud cake on the well of the well; determining the hydrostatic pressure in the well in the region in which the pressure measurement is made; calculating a pressure decay index from the mud cake permeability and thickness, the hydrostatic pressure and the measured pressure; and using the pressure decay index to analyze the measured pressure to derive the reservoir pressure.

7 Claims, 6 Drawing Sheets

U.S. PATENT DOCUMENTS

| | | | | |
|---|---|---|---|---|
| 2004/0144533 | A1* | 7/2004 | Zazovsky | 166/250.02 |
| 2005/0171699 | A1* | 8/2005 | Zazovsky et al. | 702/11 |
| 2005/0235745 | A1* | 10/2005 | Proett et al. | 73/152.22 |

FOREIGN PATENT DOCUMENTS

| | | | |
|---|---|---|---|
| EP | 0698722 | A3 | 2/1996 |
| GB | 2419424 | B | 3/2007 |

OTHER PUBLICATIONS

Chang et al, "When should we worry about supercharging in formation pressure while drilling measurements?" SPE/IADC Drilling Conference, Amsterdam, Feb. 23-25, 2005, SPE/AIDC 92380.

Goode et al, "Permeability determination with a mutliprobe formation tester", SPE Formation Evaluation, Dec. 1992, pp. 297-303, Paper (SPE 20737) first presented at the SPE Annual Technical Conference and Exhibition, New Orleans, Sep. 23-26, 1990.

Goode et al, "Influence of an invaded zone on a multiprobe formation tester", SPE Formation Evaluation, Mar. 1996, pp. 31-40. Paper (SPE 23030) first presented at the SPE Asia-Pacific Conference, Perth, Nov. 4-7, 1991.

Proett et al, "Formation pressure testing in the dynamic drilling environment", IADC/SPE Drilling Conference, Dallas, Texas, Mar. 2-4, 2004, IADC/SPE 87090.

Proette et al, "Supercharge pressure compensation using a new wireline testing method and newly developed early time spherical flow model", SPE Annual Technical Conference and Exhibition, Denver Oct. 6-9, 1996, SPE 36524.

Proette et al, "Formation testing in the dynamic drilling environment", SPWLA 45th Annual Logging Symposium, Jun. 6-9, 2004, pp. 1-14.

van Everdingen et al, "The application of the laplace transformation to flow problems in reservoirs", Petroleum Transactions AIME, Dec. 1949, pp. 305-324-B.

Banerjee et al, "A method for analysis of pressure response with a formation tester influenced by supercharging", SPE102414, 2006 SPE Russian Oil and Gas Technical Conference and Exhibition held in Moscow, Russia, Oct. 3-6, 2006, 7 pages.

* cited by examiner

METHOD FOR ANALYSIS OF PRESSURE RESPONSE IN UNDERGROUND FORMATIONS

TECHNICAL FIELD

This invention relates to methods for analysing the pressure response in an underground formation, such as might be measured from a borehole passing through the formation. In particular, the methods apply to such methods for use when the formation pressure is influenced by the supercharging effect.

CROSS-REFERENCE TO RELATED APPLICATIONS

This application claims the benefits of priority from Application Number PCT/GB2005/001820, entitled "METHOD FOR ANALYSIS OF PRESSURE RESPONSE IN UNDERGROUND FORMATIONS," filed under the PCT on May 10, 2005, which is commonly assigned to assignee of the present invention and hereby incorporated by reference in its entirety.

BACKGROUND ART

Formation pressure measurements made from wells play an important role in the management of reservoirs of underground fluids such as oil and gas. Because of their dynamic nature formation pressure measurements provide essential information on well productivity and dynamic reservoir description both in exploration and exploitation scenarios. Static pressure data can be used to compute formation fluid density and contacts. This can be important to determine reserves. Pressure transient data on the other hand can be important for estimating permeability and heterogeneity and average reservoir pressure.

Traditionally, pressure transient testing has taken the form of Drill Stem Testing (DST) or conventional well testing in which a well is put under test for a relatively long duration. While these can be excellent ways to meet test objectives, environmental and cost considerations do not allow use these techniques at all times. Wireline and LWD tools have been developed to make probe-based formation pressure measurements to address this issue.

Wireline and while-drilling formation testers counter many of the restrictions imposed by conventional well tests. While the theory of pressure transient analysis is applicable to data obtained by such formation tests, they require formulation to account for additional effects. Specifically, formation testers can be used during measurement while drilling. However, interpretation of the pressure data acquired in this dynamic environment can be challenging. One of the difficulties arises due to supercharging which results from mud filtrate invasion and changes significantly over the duration of drilling. This results in an increase in sandface pressure which is over and above the reservoir pressure. Therefore, any calculation of initial pressure and permeability must take into account the supercharging effect.

While drilling, the well bore pressure is normally maintained at a pressure substantially greater than the formation pressure by the use of drilling fluids to control production of formation fluids into the well bore (the drilling fluids or 'muds' are pumped through the wellbore and are also used for cuttings transport, cleaning of the drill bit and chemical stabilisation of the well). When a producing zone is penetrated, the wellbore sandface (the region of the wellbore wall in the producing zone) is exposed to mud pressure and filtrate immediately invades the near wellbore region. A mud cake is formed when drilling fluid flows into the formation and solids are deposited at the surface of the wellbore. This process is referred to as static filtration. As the mud cake grows it eventually stabilizes to a maximum thickness. This is as a result of the shearing action of the mud circulation as well as the mechanical action of the rotating drill pipe. This process is known as dynamic filtration. During these processes a pressure gradient is established in the formation.

A schematic description of the pressure profile with supercharging effect is shown in FIG. 1. The pressure in the wellbore near the surface of the mud cake is at hydrostatic pressure (pm) but drops rapidly across the mud cake (pa) and then gradually reduces in the formation, approaching formation (farfield) pressure (pI) some distance away from the wellbore. This near wellbore elevation in pressure above the farfield is known as the supercharging effect. From the above it is clear that if a pressure transient measurement were taken soon after drilling, any interpretation technique would have to take into account the effect of supercharged pressure.

Various techniques have been proposed to address the supercharging effect. Examples can be found in U.S. Pat. No. 5,602,334, PROETT, Mark, et al. FORMATION TESTING IN THE DYNAMIC DRILLING ENVIRONMENT. *SPWLA 45th Annual Logging Symposium*. June 6-92004., PROETT, Mark, et al. Formation Testing In the Dynamic Drilling Environment. *IADC/SPE Drilling Conference*. 2-4 Mar. 2004., PROETT, Mark, et al. Supercharge Pressure Compensation Using a New Wireline Testing Method and Newly Developed Early Time Spherical Flow Model. *SPE* 36524. 6-9 Oct. 1996, p. 329-342., GOODE, Peter, et al. Analytical models for a multiple probe formation tester. *SPE* 20737 September 1990., GOODE, Peter, et al. Influence of an invaded zone on a multiprobe formation tester. *SPE Formation Evaluation*. March 1996, p. 31-40.

This invention aims to provide a method of interpreting formation measurements that can account for the effect of supercharging.

DISCLOSURE OF THE INVENTION

One aspect of this invention provides a method of analysing a reservoir pressure in an underground formation surrounding a well, comprising:

- determining the permeability of mud cake on the wall of the well in the region in which the pressure measurement is made;
- determining the thickness of mud cake on the well of the well in the region in which the pressure measurement is made;
- determining the hydrostatic pressure in the well in the region in which the pressure measurement is made;
- measuring the formation pressure at the wall of the well;
- calculating a pressure decay index from the mud cake permeability and thickness, the hydrostatic pressure and the measured pressure; and
- using the pressure decay index to analyse the measured pressure to derive the reservoir pressure.

The pressure decay index can be calculated using the following relationship $$\beta = \frac{k_m(p_m - p_a)}{l_m k(p_a - p_I)}$$

wherein $k_m$=mud cake permeability $l_m$=mud cake thickness $p_m$=hydrostatic pressure $p_a$=measured pressure $p_I$=reservoir pressure k=permeability.

Preferably, the method further comprises deriving at least one of horizontal permeability, vertical permeability and productivity index of the well in the region of the measurement.

A method according to the invention can comprise estimating at least one parameter and using non-linear regression to modify this estimate until the calculated or derived parameters result in correspondence with measured parameters.

Typical inputs to the analysis include a calculated invasion rate derived from mud cake properties, transient pressure computations from reservoir fluid and rock properties, formation pressure tester probe configuration parameters, pressure sampling rate and duration, and pressure transient data obtained from the pressure measurement.

With these inputs, the method preferably comprises determining a goodness of fit of pressure transient data.

In one embodiment of a method according to the invention, mud and mud cake properties are used to calculate invasion rate, and this invasion rate is applied, together with reservoir fluid properties, tester and formation configuration data and test data to a model with regression to provide reservoir pressure, permeability and productivity parameters.

The methods according to the invention can be applied to measurements made with wireline or while drilling formation tester tools.

MODE(S) FOR CARRYING OUT THE INVENTION

This invention applies to measurements of formation pressure made using wireline pressure measurement tools, such as the MDT of Schlumberger, or more recent formation pressure while drilling (FPWD) tools. These are not described in detail here at their performance and properties are well known. These tools generally operate by applying a test probe against the wall of the wellbore (sandface) through any mud cake that might be present, and making pressure measurements and, optionally, taking samples of the formation fluid through the probe. Such measurements typically obtain data in the form of pressure and flow development over a period of time.

Data from such measurements are obtained digitally and are typically analysed by means of dedicated software applications to provide an indication of the formation properties around the well. The method of the present invention is based on a series of mathematical formulae that are discussed in more detail below. Variations may be made to these formulae while still retaining the essential methodology of the invention.

Figure 1:
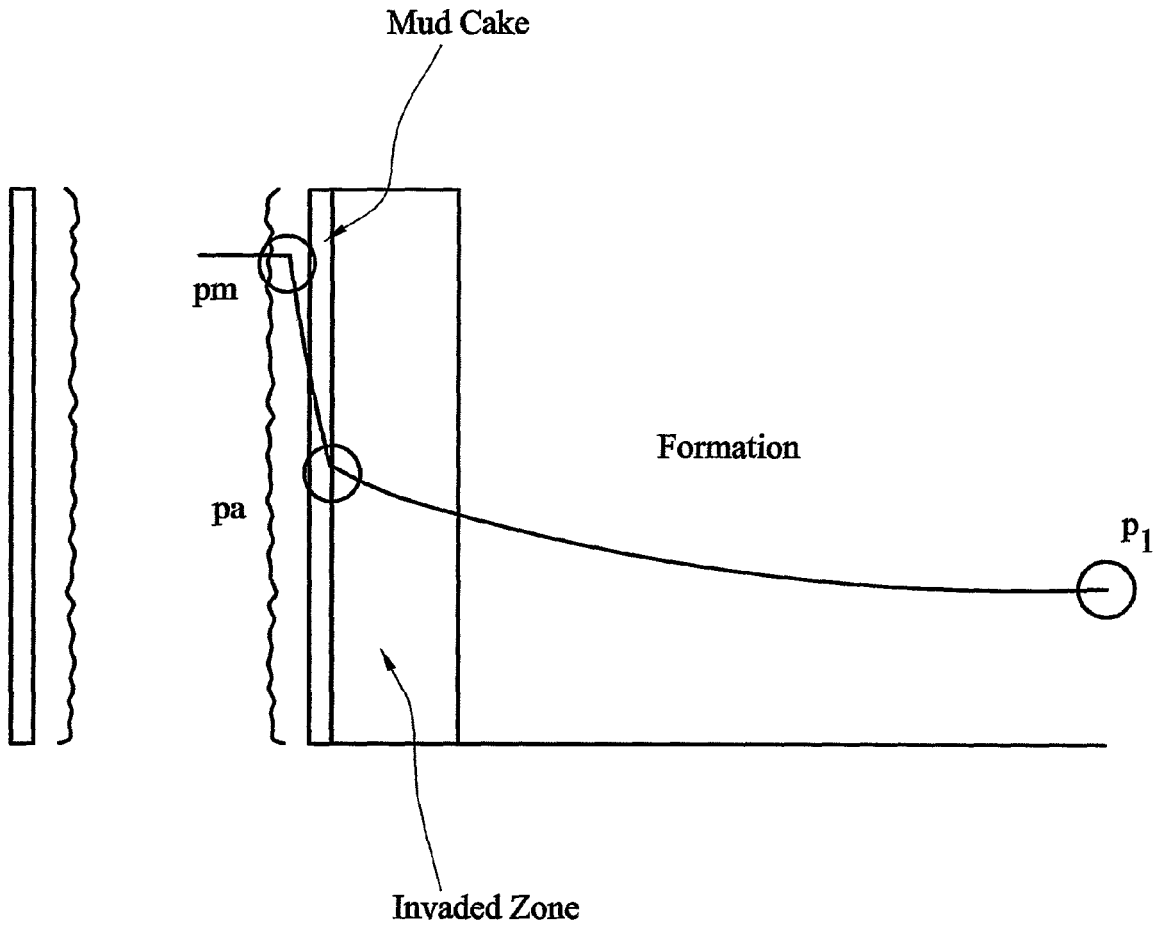
FIG. 1 shows a schematic diagram of a formation with supercharging.
Figure 2:
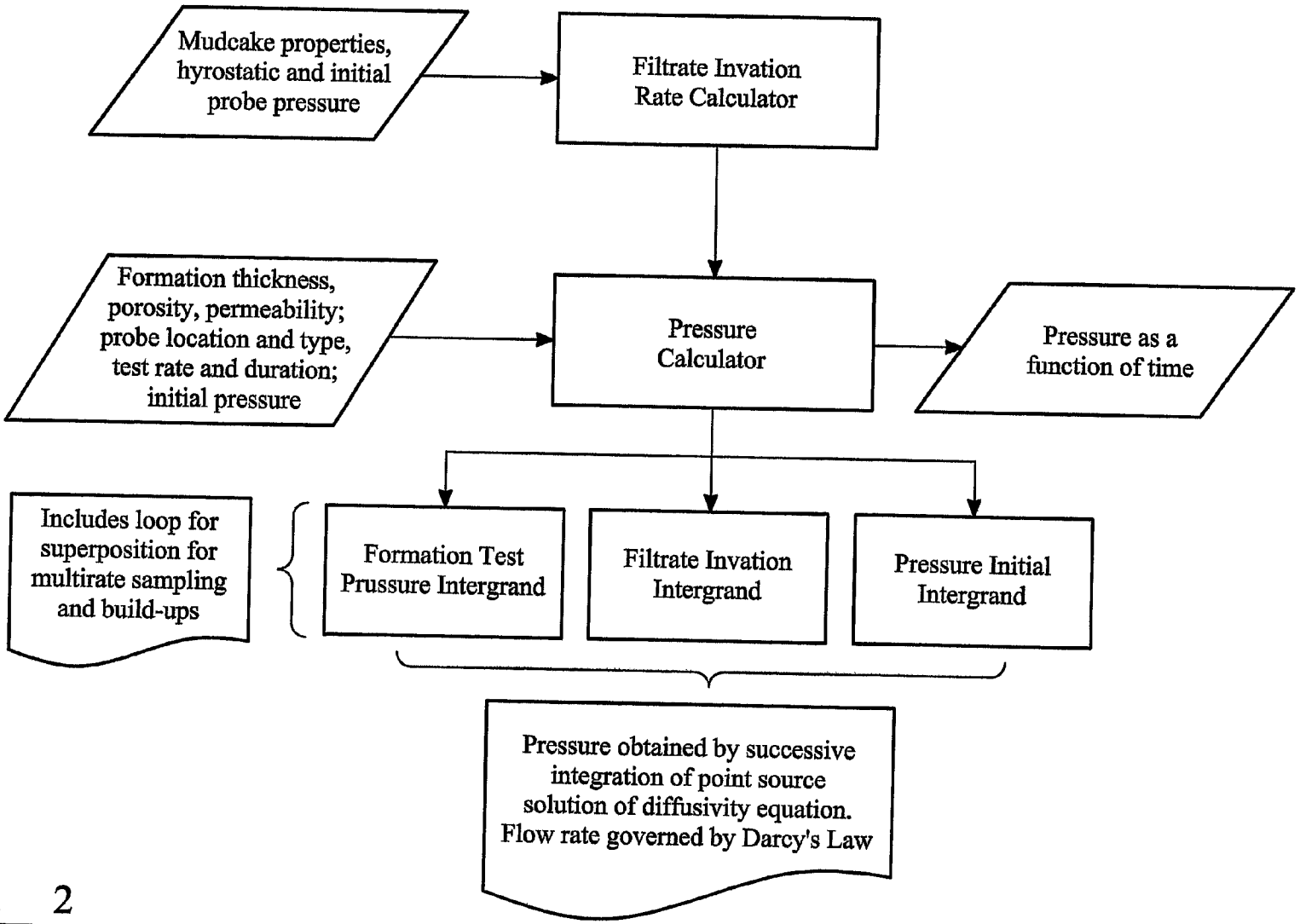
FIG. 2 shows a schematic structure of the mathematical formulae underlying the embodiment of the invention.

A structure for the derived mathematical formulae underlying one embodiment of the invention is presented in FIG. 2. In this case, the most important component is the pressure calculator that combines, by superposition, the formation test pressure response, filtrate invasion pressure response and diffusion of initial supercharged pressure. The filtrate invasion rate calculator computes the invasion rate that is used by the pressure calculator. In this case, the parameters to be computed from the formation pressure test are horizontal permeability, vertical permeability and undisturbed reservoir pressure. These parameters are used to estimate the productivity index of the well (PI). In addition, the initial pressure decay factor $\beta$ is also determined.

The equations, presented in more detail below, assume a single-phase approximation; that is, the mobility of the mud filtrate and the reservoir fluid are similar. This assumption is approximately true in many cases. The effect of any divergence from this approximation can be neglected because the radius of mud filtrate invasion is generally much smaller than the radius of investigation, even for a wireline formation test.

Figure 3:
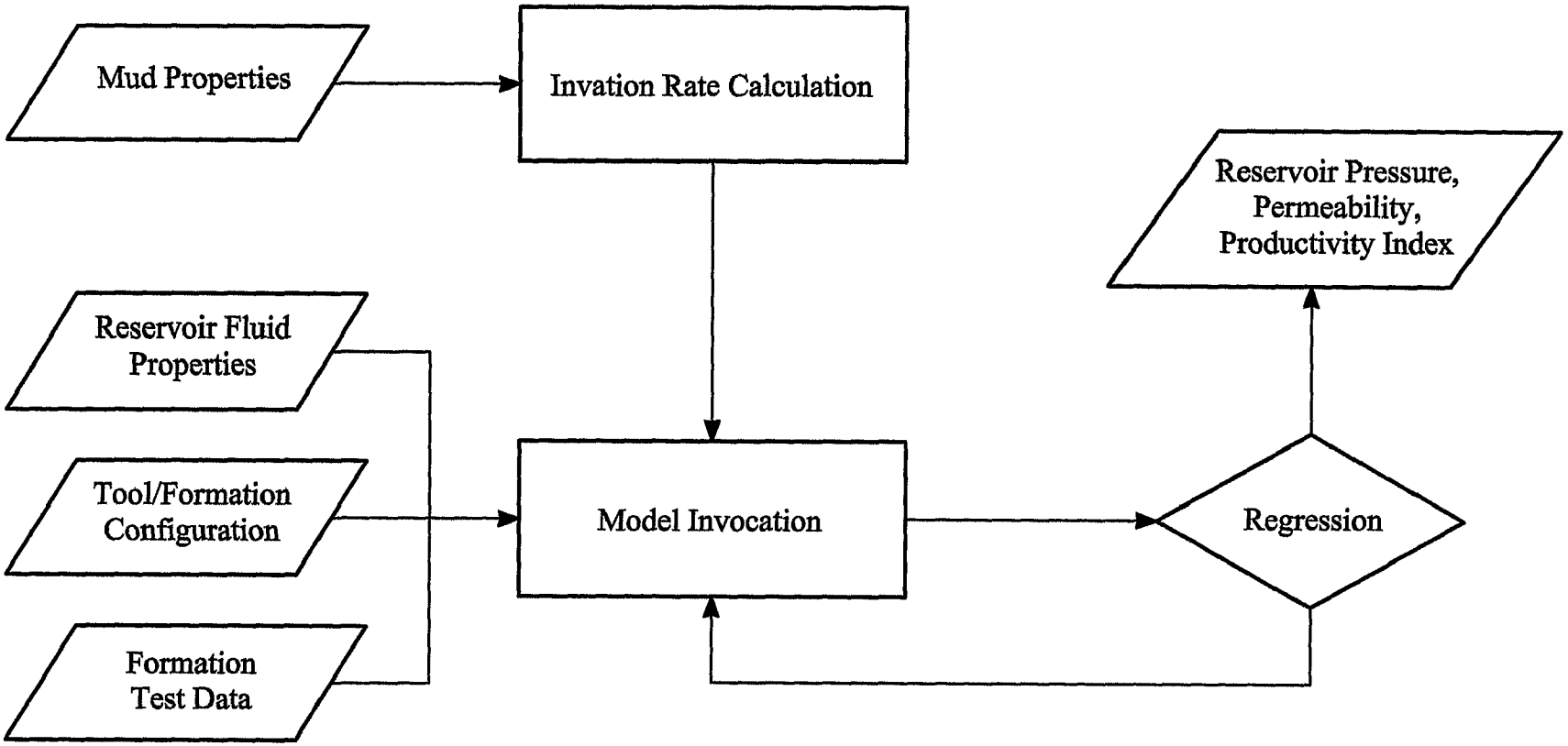
FIG. 3 is a flow diagram of an interpretation workflow incorporating a method according to the invention.

A flow diagram of an interpretation workflow incorporating a method according to the invention is presented in FIG. 3.

The pressure calculator is a forward model. It computes pressure response as a function of time based on input parameters, some of which it is desired to compute in the first place. The pressure calculator is therefore used in a non-linear regression loop starting with the first estimates of the parameters of interest. A first estimate of horizontal permeability is obtained from logs taken while drilling or subsequently, vertical permeability is defaulted to 10 percent of horizontal permeability, and the initial reservoir pressure is considered to be hydrostatic pressure. A first estimate of the decay factor is taken using the method described below. The non-linear regression module is a standard, gradient-based algorithm tuned for pressure transient interpretation. The final outcome is the matched formation test pressure and the tuned parameters.

Knowing the reservoir pressure the productivity index of the well can be computed using standard industry methods.

In summary, data entry consists of the following:

a) Mud cake properties to calculate invasion rate.

b) Reservoir fluid and rock properties for the transient pressure computation. This includes initial estimates of output parameters.

c) Formation tester probe configuration.

d) Sampling rate and duration.

e) Corresponding pressure transient data.

The program outputs the following parameters:

a) Reservoir horizontal and vertical permeability b) Initial reservoir pressure c) Well productivity index d) Goodness of fit of the pressure transient data.

Figure 4:
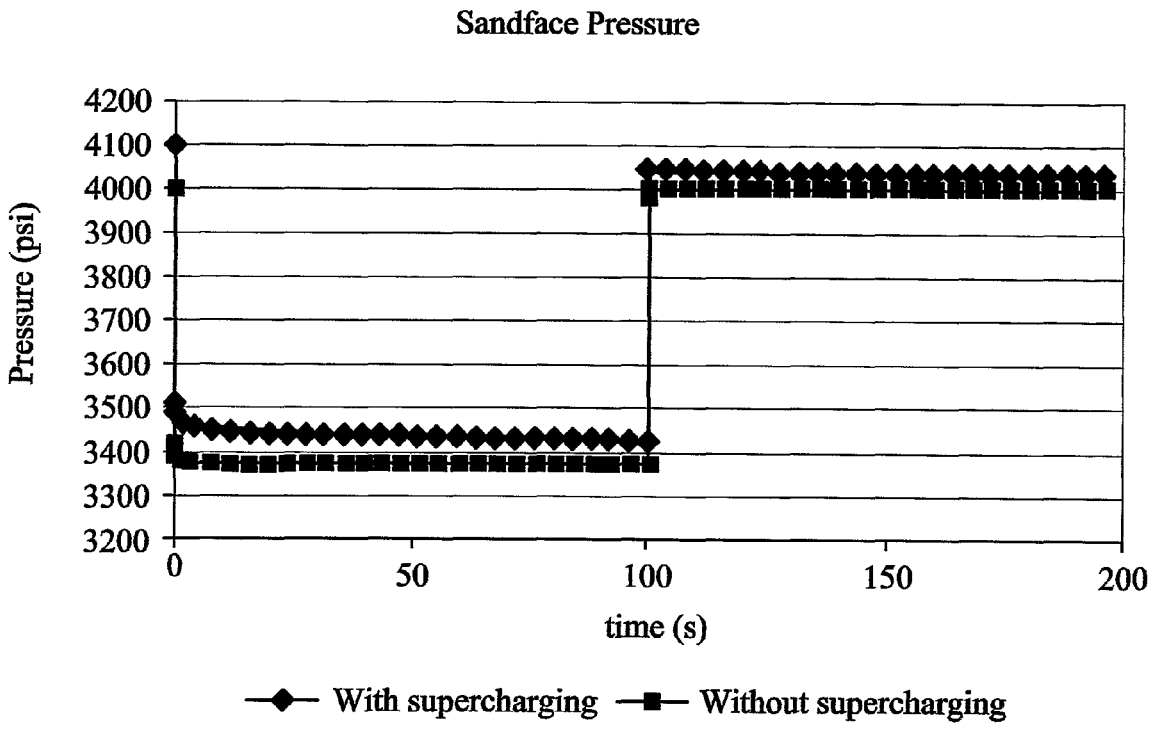
FIG. 4 shows a comparison of pressure response with and without supercharging.
Figure 5:
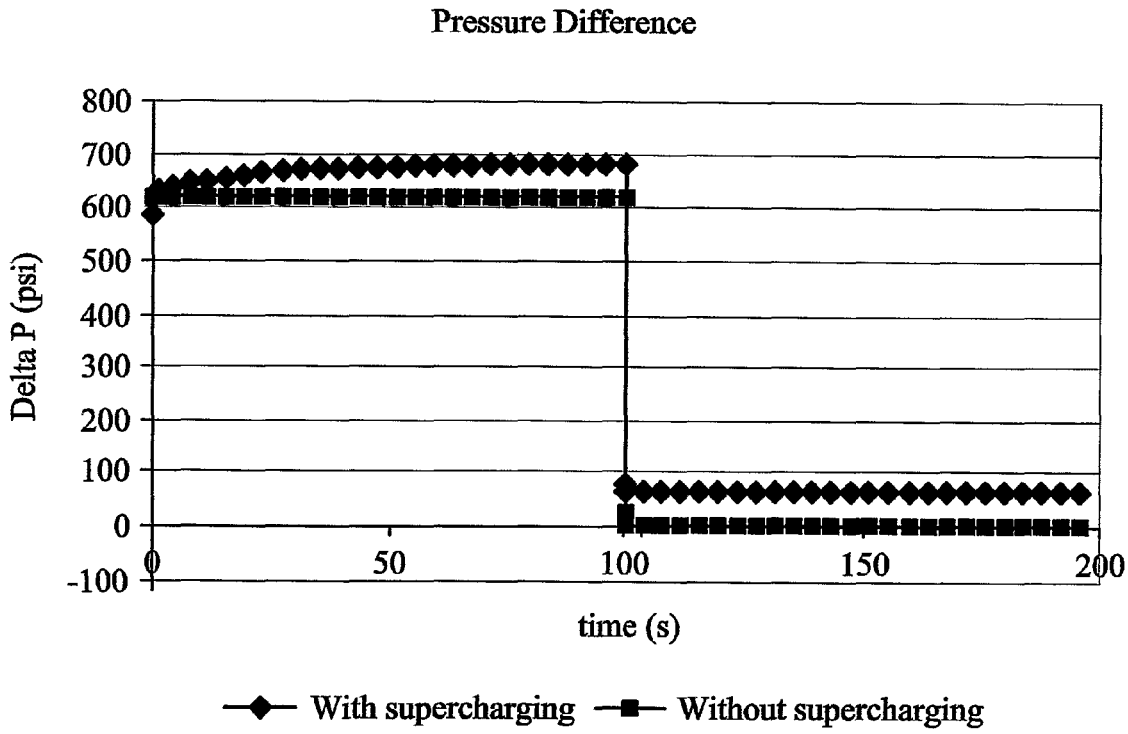
FIG. 5 is the pressure difference plot.

The workflow can handle multiple probes. Therefore, both pre-test and vertical interference test can be analyzed. Outside the regression loop the pressure calculator is used for test design. Supercharging effect is generally prominent in low permeability reservoirs. FIG. 4 shows a comparison of pressure response with and without supercharging. FIG. 5 is the pressure difference plot. It is clear that the pressure profile is not only displaced but also has a different shape. This means that the permeability estimated by using the standard formation tester model would be different from that obtained by the proposed model, thus reinforcing the need to use the correct model.

Figure 6:
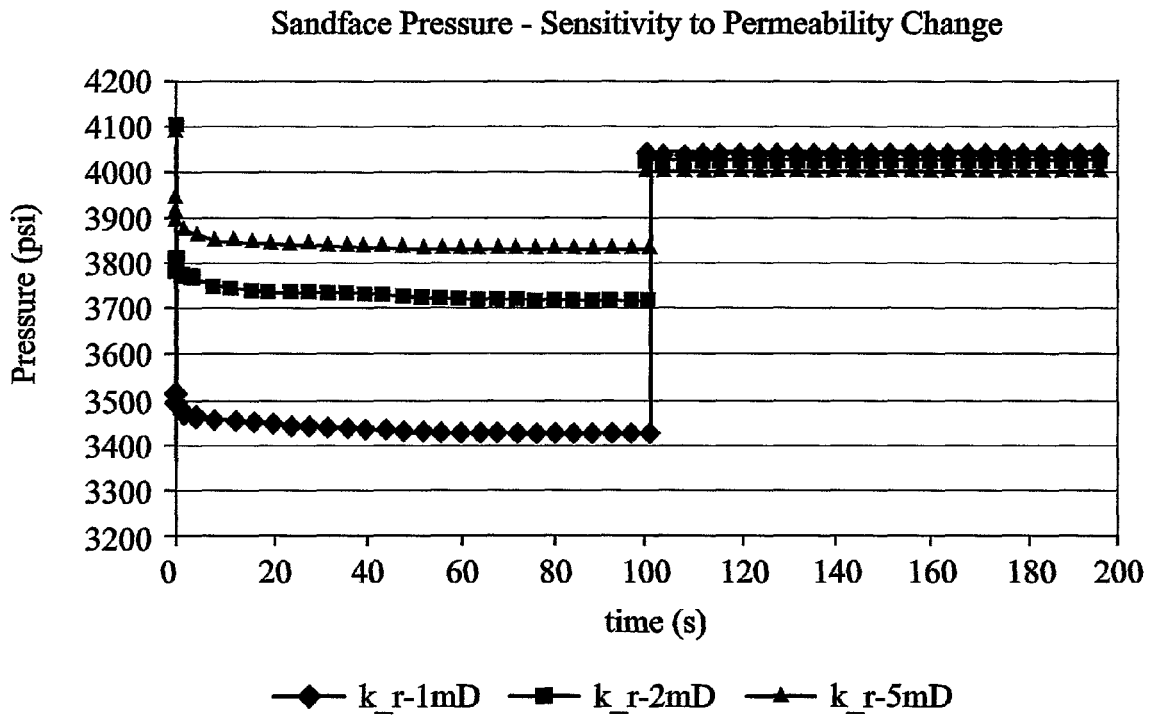
FIG. 6 shows the sensitivity to change in permeability.
Figure 7:
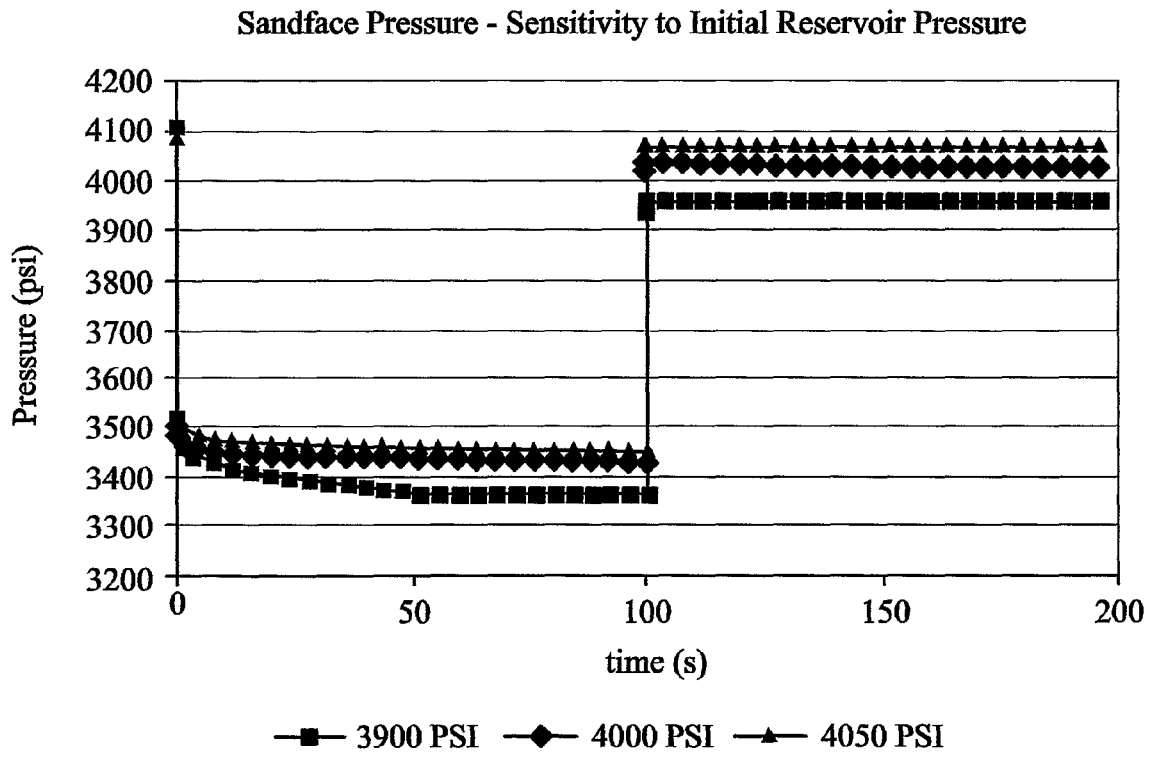
FIG. 7 shows the sensitivity to change in initial reservoir pressure.
Figure 8:
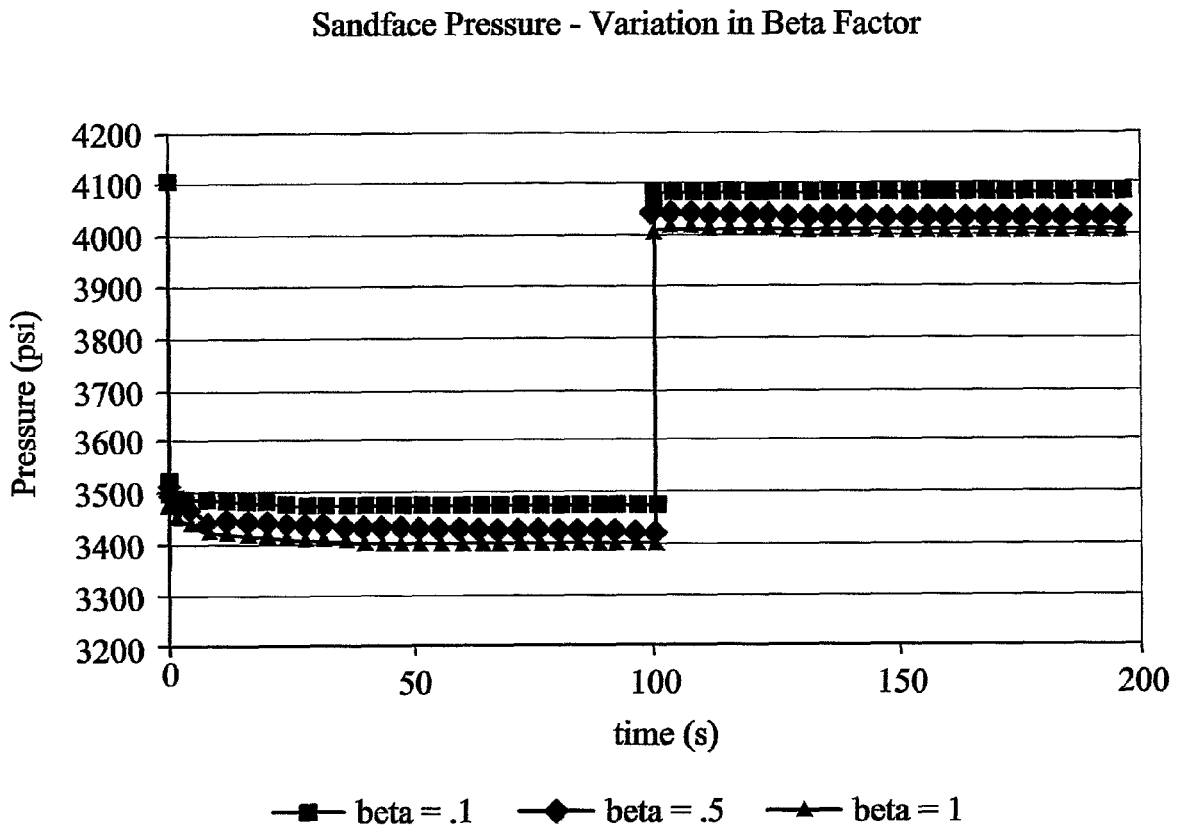
FIG. 8 shows the sensitivity to change in beta factor (pressure decay index).

The sensitivity to change in permeability, initial reservoir pressure and beta factor (pressure decay index) is presented in FIGS. 6, 7 and 8. Note that the clear separation of stabilized pressure during buildup in FIG. 6. This shows the effect of filtrate loss during buildup. In FIG. 7 the curvature of the pressure curve increases with the increase in difference between the initial probe pressure and the initial reservoir pressure. Thus, the larger the supercharging effect, the higher will be the discrepancy when using a standard model. In addition to determining the initial distribution of pressure, the decay factor also determines how fast the supercharging effect diffuses in the reservoir. This is demonstrated in FIG. 8. These figures also show that the pressure response is sensitive to the above-mentioned parameters and therefore can be resolved using non-linear regression.

The pressure calculator hooked to a standard non-linear regression routine is used to test the interpretation workflow. The observed test data used in our case is generated synthetically with a-priori knowledge of the reservoir parameters. Three cases are investigated. The probe pressure at the start of the test is fixed at 4100 psi. In the first case, the horizontal and vertical permeabilities are perturbed from the known values but the initial pressure is fixed. In the second case all the three parameters are perturbed. A comparison of the two cases suggests that while an increase in the number of unknowns adversely affects the quality of match, it is still good enough for all practical purposes. In the third case the initial pressure and filtrate invasion terms are disabled; that is, the match is obtained with a standard model used in formation testing. The match obtained is extremely poor, which is a clear demonstration of the need for specialized models. The actual values and the match obtained for the three cases are illustrated in the table below:

TABLE 1

| | Actual Value | Match with Perm unknown | Match with Perm + Initial Pressure unknown | Match with sample-only model |
|---|---|---|---|---|
| Horizontal Permeability (md) | 1 | 1.01 | 1.15 | 5.0 |
| Vertical Permeability (md) | 0.1 | 0.99 | 0.95 | 2.0 |
| Initial Pressure | 4000 | 4000 | 4002 | 4100 |

A summary of the essential physical problem to be modelled and the mathematical formulation underlying the formulae used in the methods of the invention is given below. It will be appreciated that deviation may be made from these formulae while still staying within the scope of the invention.

The solution in this case is obtained by the application of successive integral transforms to the governing equations and to the associated initial and boundary conditions. A brief exposition of the problem is given below.

The medium is bounded by the cylinder r=a and extends to ∞ in the direction of r positive. There are two cases in the z direction. In the first, z is unbounded; that is, $(-\infty<z<\infty)$, and in the second, the formation is of thickness h; that is, $(0<z<h)$ and has a no-flow boundary condition at the upper and lower boundary. An initial condition is superimposed, given by $$p(r,\theta,z,t_0)=(p_a-p_I)e^{-\beta(r-a)}+p_I \tag{1}$$

The supercharged pressure, $p_a$, is greater than the reservoir pressure, $p_I$, due to the invasion of mud filtrate into the reservoir. Equation 1 shows an exponential decline of pressure from sandface to reservoir. When time $t=t_0=0$ (beginning of the test), r=a (at the sandface), $p(a,\theta,z,0)=p_a$ and as $r\rightarrow\infty$, $p=p_I$. This decline might be represented by any arbitrary function. However, considering the nature of pressure diffusion, the exponential representation is accurate enough. The decay factor β determines the curvature of the pressure profile in the reservoir and depends on fluid and rock properties. It is possible to approximate this factor through actual reservoir simulation. Alternatively, a more simplistic but straightforward approach is to determine it from actual transient tests by non-linear regression. Since $p_a$ is measured, in theory, if the mud filtrate invasion process can be rigorously modelled, it should be possible to compute $p_I$ without having to impose an initial condition of the type given by Equation 1. For example, if the invasion history is known and the near well bore reservoir description is fairly accurate a reservoir simulator can be used to compute the supercharged pressure. However, this process is laborious and, often, without sufficient reliable data to validate the model. Hence, the focus of the methods of this invention is to be able to take advantage of the recorded pressure transient data. The pressure transient data influenced by the supercharged formation is interpreted to obtain reservoir parameters as well as the initial reservoir pressure ($p_I$), without having to resort to complex workflows. Instead of modelling how the pressure builds up to $p_a$ from $p_I$, an initial condition is imposed that is simple but can be history matched to the measured pressure transient data.

This approach is illustrated with reference to two cases discussed below

Case 1.0: The medium is bounded by the cylinder r=a and extends to ∞ in the direction of r positive and $$(-\infty<z<\infty)\cdot\frac{\partial_p(a,\theta,z,t)}{\partial_r}=-\left(\frac{\mu}{k}\right)_a q_M$$

The initial pressure situation is:

$$p(r,\theta,z,t_0)=(p_a-p_I)e^{-\beta(r-\alpha)}+p_I;\ p(a,\theta,z,t_0)=p_a$$

A continuous source at $[a, 0, z_0]$ is introduced and the resulting pressure disturbance left to diffuse through a semi-infinite homogeneous porous medium.

The solution in Laplace space is given by $$\bar{p}(a,0,z,s)= \tag{2}$$

$$\frac{2q(s)e^{-st_0}}{\pi^3\phi c_t a^2\sqrt{\eta_z}}\sum_{m=0}^{\infty}\ni_m\int_0^{\infty}\frac{e^{-|z-z_0|\sqrt{\frac{\eta_r\xi^2+s}{\eta_z}}}}{\xi(\eta_r\xi^2+s)\{J_M'^2(\xi a)+Y_m'^2(\xi a)\}}d\xi++$$

$$\frac{4\eta_r}{\pi^2 a}\left(\frac{\mu}{k}\right)_M q_M(s)\int_0^{\infty}\frac{1}{\xi(\eta_r\xi^2+s)\{J_0'^2(\xi a)+Y_0'^2(\xi a)\}}d\xi++$$

$$\frac{2(p_a-p_I)e^{\beta\alpha}}{\pi a}\int_0^{\infty}\frac{V_0(\xi a)}{(\eta_r\xi^2+s)\{J_0'^2(\xi a)+Y_0'^2(\xi a)\}}d\xi+\frac{p_I}{s}$$

and in real time $$\bar{p}(a,0,z,t)=\frac{2U(t-t_0)}{\pi^3\phi c_t a^2\sqrt{\pi\eta_z}}\sum_{m=0}^{\infty}\ni_m \tag{3}$$

$$\int_0^{\infty}\int_0^{t-t_0}\frac{q(t-t_0-\tau)e^{-\eta_r\xi^2\tau-\frac{(z-z_0)^2}{4\eta_z\tau}}}{\xi\sqrt{\tau}\{J_m'^2(\xi a)+Y_m'^2(\xi a)\}}d\tau d\xi++$$

$$\frac{4\eta_r}{\pi^2 a}\left(\frac{\mu}{k}\right)_M(s)\int_0^{\infty}\int_0^{t}\frac{q_M(t-\tau)e^{-\eta_r\xi^2\tau}}{\xi\{J_0'^2(\xi a)+Y_0'^2(\xi a)\}}d\tau d\xi++$$

$$\frac{2(p_a-p_I)e^{\beta\alpha}}{\pi a}\int_0^{\infty}\frac{V_0(\xi a)e^{-\eta_r\xi^2\tau}}{\{J_0'^2(\xi a)+Y_0'^2(\xi a)\}}d\xi+p_I$$

For constant q equation (3) reduces to $$\overline{p}(a, 0, z, t) = \tag{4}$$

$$\frac{U(t-t_0)q}{\pi^3\phi c_t a^2\sqrt{\pi\eta_r\eta_z}}\sum_{m=0}^{\infty}\ni_m\int_0^{\infty}\frac{e^{-\xi(z-z_0)\sqrt{\frac{\eta_r}{\eta_z}}}}{\xi^2\{J_m'^2(\xi a)+Y_m'^2(\xi a)\}}\times\times$$

$$\left\{2-e^{2\xi(z-z_0)\sqrt{\frac{\eta_r}{\eta_z}}}\operatorname{erfc}\left(\xi\sqrt{\eta_r(t-t_0)}+\frac{(z-z_0)}{2\sqrt{\eta_z(t-t_0)}}\right)+\right.$$

$$\left.\operatorname{erfc}\left(\xi\sqrt{\eta_r(t-t_0)}-\frac{(z-z_0)}{2\sqrt{\eta_z(t-t_0)}}\right)\right\}d\xi++$$

$$\frac{4\eta_r}{\pi^2 a}\left(\frac{\mu}{k}\right)_M\int_0^{\infty}\int_0^{t}\frac{q_M(t-\tau)e^{-\eta_r\xi^2\tau}}{\xi\{J_0'^2(\xi a)+Y_0'^2(\xi a)\}}d\tau d\xi++$$

$$\frac{2(p_a-p_I)e^{\beta\alpha}}{\pi a}\int_0^{\infty}\frac{V_0(\xi a)e^{-\eta_r\xi^2\tau}}{\{J_0'^2(\xi a)+Y_0'^2(\xi a)\}}d\xi+p_I;\ z>z_0$$

If $z<z_0$ we interchange z and $z_0$, where $$\eta_r=\frac{k_r}{\phi c_t\mu}\ \text{and}\ \eta_z=\frac{k_z}{\phi c_t\mu}$$

$$U(t-t_0)=\begin{cases}0 & t<t_0\\ 1 & t\geq t_0\end{cases}$$

$$\ni_m=\begin{cases}\frac{1}{2} & m=0\\ 1 & m=1,2,3,\ldots\end{cases}$$

$$G_v(\xi r)=\{Y_\upsilon'(\xi a)J_\upsilon(\xi r)-J_\upsilon'(\xi a)Y_\upsilon(\xi r)\}\ \text{and}$$

$$V_0(\xi a)=\int_a^{\infty}re^{-\beta r}G_0(\xi r)dr$$

$$J_\upsilon(x)=\sum_{n=0}^{\infty}\frac{(-1)^n\left(\frac{x}{2}\right)^{\upsilon+2n}}{n!\Gamma(\upsilon+n+1)}\ \text{Bessel function of the first kind of order}\ \upsilon$$

$$Y_\upsilon(x)=\frac{J_\upsilon(x)\cos(\upsilon\pi)-J_{-\upsilon}(x)}{\sin(\upsilon\pi)}\ \text{Bessel function of the second kind of order}\ \upsilon$$

Case 2.0: The medium is bounded by the cylinder r=a and extends to ∞ in the direction of r positive and $$(0<z<h)\cdot\frac{\partial_p(a,\theta,z,t)}{\partial_r}=-\left(\frac{\mu}{k}\right)_a q_M$$

The initial pressure situation is $$p(r,\theta,z,t_0)=(p_a-p_I)e^{-\beta(r-a)}+p_I;\ p(a,\theta,z,t_0)=p_a$$

A continuous source at [a, 0, $z_0$] is introduced and the resulting pressure disturbance left to diffuse through a semi-infinite homogeneous porous medium.

The solution in Laplace space is given by $$\overline{p}(a,0,z,s)=\frac{4q(s)e^{-st_0}}{\pi^3 ha^2\phi c_t}\sum_{m=0}^{\infty}\ni_m\sum_{n=0}^{\infty}\ni_n\cos\left(\frac{n\pi z_0}{h}\right)\cos\left(\frac{n\pi z}{h}\right)\times\times \tag{5}$$

$$\int_0^{\infty}\frac{1}{\xi\left(\eta_r\xi^2+\eta_z\left(\frac{n\pi}{h}\right)^2+s\right)\{J_m'^2(\xi a)+Y_m'^2(\xi a)\}}d\xi++$$

$$\frac{4}{\pi^2 a}\left(\frac{\mu}{k}\right)_M q_M(s)\int_0^{\infty}\frac{1}{\xi(\eta_r\xi^2+s)\{J_0'^2(\xi a)+Y_0'^2(\xi a)\}}d\xi++$$

$$\frac{2(p_a-p_I)e^{\beta\alpha}}{\pi a}\int_0^{\infty}\frac{V_0(\xi a)}{(\eta_r\xi^2+s)\{J_0'^2(\xi a)+Y_0'^2(\xi a)\}}d\xi+\frac{p_I}{s}$$

and in real time $$\overline{p}(a,0,z,t)=\frac{U(t-t_0)}{\pi^3 ha^2\phi c_t}\sum_{m=0}^{\infty}\ni_m\int_0^{\infty}\frac{1}{\xi\{J_m'^2(\xi a)+Y_m'^2(\xi a)\}}\int_0^{t-t_0}q(t- \tag{6}$$

$$t_0-\tau)\times\times\left[\Theta_3\left\{\frac{\pi(z-z_0)}{2h},e^{-\left(\frac{\pi}{h}\right)^2\eta_z\tau}\right\}+\right.$$

$$\left.\Theta_3\left\{\frac{\pi(z+z_0)}{2h},e^{-\left(\frac{\pi}{h}\right)^2\eta_z\tau}\right\}\right]e^{-\eta_r\xi^2\tau}d\tau d\xi++$$

$$\frac{4}{\pi^2 a}\left(\frac{\mu}{k}\right)_M\int_0^{\infty}\int_0^{t}\frac{q_M(t-\tau)e^{-\eta_r\xi^2\tau}}{\xi\{J_0'^2(\xi a)+Y_0'^2(\xi a)\}}d\tau d\xi++$$

$$\frac{2(p_a-p_I)e^{\beta\alpha}}{\pi a}\int_0^{\infty}\frac{V_0(\xi a)e^{-\eta_r\xi^2\tau}}{\{J_0'^2(\xi a)+Y_0'^2(\xi a)\}}d\xi+p_I$$

For constant q equation (6) reduces to $$\overline{p}(a,0,z,t)=\frac{U(t-t_0)q}{\pi^3 ha^2\phi c_t}\sum_{m=0}^{\infty}\ni_m \tag{7}$$

$$\int_0^{\infty}\frac{1}{\xi\{J_m'^2(\xi a)+Y_m'^2(\xi a)\}}\int_0^{t-t_0}\left[\Theta_3\left\{\frac{\pi(z-z_0)}{2h},e^{-\left(\frac{\pi}{h}\right)^2\eta_z\tau}\right\}+\right.$$

$$\left.\Theta_3\left\{\frac{\pi(z+z_0)}{2h},e^{-\left(\frac{\pi}{h}\right)^2\eta_z\tau}\right\}\right]e^{-\eta_r\xi^2\tau}d\tau d\xi++$$

$$\frac{4}{\pi^2 a}\left(\frac{\mu}{k}\right)_M\int_0^{\infty}\int_0^{t}\frac{q_M(t-\tau)e^{-\eta_r\xi^2\tau}}{\xi\{J_0'^2(\xi a)+Y_0'^2(\xi a)\}}d\tau d\xi++$$

$$\frac{2(p_a-p_I)e^{\beta\alpha}}{\pi a}\int_0^{\infty}\frac{V_0(\xi a)e^{-\eta_r\xi^2\tau}}{\{J_0'^2(\xi a)+Y_0'^2(\xi a)\}}d\xi+p_I$$

Where $$\Theta_3\{x,Q\}=1+2\sum_{n=1}^{\infty}Q^{n^2}\cos(2nx)\ [|Q|<1]$$

Elliptic theta function of the third kind

The mud filtrate invasion, $q_M$, could be modelled using any analytical function of time. However, for simplicity it is assumed that the mud cake is relatively thin compared to the well diameter and linear Darcy's law can be applied. This gives, $$q_M=\frac{2\pi ahk_m}{\mu l_m}(p_m-p_a) \tag{8}$$

where $k_m$ and $l_m$ are the permeability and thickness of the mud cake respectively and μ is the mud filtrate viscosity.

The pressure decay factor β describes the decay of the reservoir from the supercharged sandface pressure to the initial reservoir pressure. An initial estimate of β can be derived by imposing continuity of flow across sandface, which is $$\beta = \frac{k_m(p_m - p_a)}{l_m k(p_a - p_I)} \tag{9}$$

The effect of tool storage can be incorporated in the pressure solution by applying Duhamel's principle.

Nomenclature:

a wellbore radius, m.
$c_t$ compressibility, $P_a^{-1}$
ϕ porosity, fraction.
h layer thickness, m.
$J_v$ vth order Bessel function of first kind.
$J'_v$ derivative of vth order Bessel function of first kind.
$Y_v$ vth order Bessel function of second kind.
$Y'_v$ derivative of vth order Bessel function of second kind.
$k_m$ mud filtrate permeability, $m^2$
$k_r$ horizontal permeability, $m^2$
$k_z$ vertical permeability, $m^2$
$l_m$ mud filtrate thickness, m.
μ viscosity, $P_a$·s.
p pressure, $P_a$.
$p_a$ probe pressure, $P_a$.
$p_I$ reservoir pressure, $P_a$.
$p_m$ hydrostatic pressure, $P_a$.
q sampling rate, $m^3/s$.
$\theta_3$ elliptic theta function of the third kind.
$q_{\mathcal{M}}$ invasion rate, $m^3/s$.
s Laplace variable.
t time, s.
$t_0$ time at start of test, s.

The invention claimed is:

1. A method for analysing a reservoir pressure in an underground formation surrounding a well, comprising:

measuring a pressure at a wall of the well;

determining a permeability of mud cake on the wall of the well in the region in which the pressure measurement is made;

determining a thickness of mud cake on the well of the well in the region in which the pressure measurement is made;

determining a hydrostatic pressure in the well in the region in which the pressure measurement is made;

calculating a pressure decay index from the mud cake permeability and thickness, the hydrostatic pressure and the measured pressure; and using the pressure decay index and the measured pressure to derive the reservoir pressure.

2. A method as claimed in claim 1, wherein the pressure decay index is calculated using the following relationship $$\beta = \frac{k_m(p_m - p_a)}{l_m k(p_a - p_I)}$$

wherein $k_m$ =mud cake permeability
$l_m$ =mud cake thickness
$p_m$ =hydrostatic pressure
$p_a$ =measured pressure
$p_I$ =reservoir pressure
k =permeability.

3. A method as claimed in claim 1, further comprising deriving at least one of horizontal permeability, vertical permeability and a productivity index of the well in the region of the pressure measurement.

4. A method as claimed in claim 1, further comprising using mud and mud cake properties to calculate an invasion rate, and applying this invasion rate together with reservoir fluid properties, tester and formation configuration data and test data to a model with regression to provide reservoir pressure, permeability and productivity parameters.

5. A method as claimed in claim 1, wherein the pressure measurement comprises a sandface pressure measurement.

6. A method as claimed in claim 1, wherein inputs to the analysis include a calculated invasion rate derived from mud cake properties, transient pressure computations from reservoir fluid and rock properties, formation pressure tester probe configuration parameters, pressure sampling rate and duration, and pressure transient data obtained from the pressure measurement.

7. A method as claimed in claim 6, further comprising determining a goodness of fit of pressure transient data.

* * * * *